US007208729B2

(12) United States Patent
Syms

(10) Patent No.: US 7,208,729 B2
(45) Date of Patent: Apr. 24, 2007

(54) MONOLITHIC MICRO-ENGINEERED MASS SPECTROMETER

(75) Inventor: Richard Syms, London (GB)

(73) Assignee: Microsaic Systems Limited, London (GB)

( * ) Notice: Subject to any disclaimer, the term of this patent is extended or adjusted under 35 U.S.C. 154(b) by 291 days.

(21) Appl. No.: 10/522,638

(22) PCT Filed: Jul. 29, 2003

(86) PCT No.: PCT/EP03/08354

§ 371 (c)(1),
(2), (4) Date: Jan. 25, 2005

(87) PCT Pub. No.: WO2004/013890

PCT Pub. Date: Feb. 12, 2004

(65) Prior Publication Data

US 2006/0071161 A1 Apr. 6, 2006

(30) Foreign Application Priority Data

Aug. 1, 2002 (GB) ..... 0217815.0

(51) Int. Cl.
*H01J 49/00* (2006.01)

(52) U.S. Cl. ..... 250/288; 250/290; 250/281; 250/396 R

(58) Field of Classification Search ..... 250/288
See application file for complete search history.

(56) References Cited

U.S. PATENT DOCUMENTS 5,386,115 A * 1/1995 Freidhoff et al. ..... 250/281
5,401,962 A 3/1995 Ferran
5,719,393 A 2/1998 Chutjian et al.
6,025,591 A 2/2000 Taylor et al.
6,188,067 B1 2/2001 Shutjian et al.
6,442,831 B1 * 9/2002 Khandros et al. ..... 29/843
6,465,792 B1 * 10/2002 Baptist ..... 250/396 R

FOREIGN PATENT DOCUMENTS

WO WO97/47025 12/1997

OTHER PUBLICATIONS

J.J. Tunstall et al., "Silicon Micromachined Mass Filter for a Low Power, Low Cost Quadrupole Spectrometer," Micro Electro Mechanical Systems, 1998. Mems 98. Proceedings, the Eleventh Annual International Workshop on Heidelberg, Germany Jan. 25-29, 1998, New York, NY USA, IEEE, US, pp. 438-442.
J.H. Batey, "Quadrupole Gas Analysers," Vacuum 37, 659-668 (1987).

* cited by examiner

*Primary Examiner*—David A. Vanore
*Assistant Examiner*—Phillip A Johnston
(74) *Attorney, Agent, or Firm*—McDermott Will & Emery LLP

(57) ABSTRACT

A method of constructing a micro-engineered mass spectrometer from bonded silicon-on-insulator (BSOI) wafers is described with reference to a quadrupole spectrometer. The quadrupole geometry is achieved using two BSOI wafers (200), which are bonded together to form a monolithic block (410). Deep etched features and springs formed in the outer silicon layers are used to locate cylindrical metallic electrode rods (300). The precision of the assembly is determined by a combination of lithography and deep etching, and by the mechanical definition of the bonded silicon layers. Deep etched features formed in the inner silicon layers are used to define ion entrance and ion collection optics. Other features such as fluidic channels may be incorporated.

37 Claims, 11 Drawing Sheets a)

b)

a)

b)

a)

b)

a)

b)

a)

b)

MONOLITHIC MICRO-ENGINEERED MASS SPECTROMETER

This application claims priority from PCT Application No. PCT/EP2003/008354, filed 29 Jul. 2003 (incorporated by reference herein), and British Application No. 0217815.0, filed 1 Aug. 2002 (incorporated by reference herein).

FIELD OF THE INVENTION

The invention relates to mass spectrometers and in particular to micro-engineered mass spectrometers.

BACKGROUND TO THE INVENTION

Mass spectrometers are well known in the art and have particular application in sample measurements. It is also well known to provide miniaturised devices which have particular application as portable measurement systems. The use of such spectrometers is varied from the detection of biological and chemical materials, drugs, explosives and pollutants, to use as instruments for space exploration, as residual gas analysers and as instruments for process control. Mass spectrometers consist of three main subsystems: an ion source, an ion filter, and an ion counter. Since these may all be based on different principles, there is scope for a variety of systems to be constructed.

One of the most successful variants is the quadrupole mass spectrometer, which uses a quadrupole electrostatic lens as a mass filter. Conventional quadrupole lenses such as those described in Batey J. H. "Quadrupole gas analysers" Vacuum 37, 659–668 (1987) consist of four cylindrical electrodes, which are mounted accurately parallel and with their centre-to-centre spacing at a well-defined ratio to their diameter.

Ions are injected into a pupil located between the electrodes, and travel parallel to the electrodes under the influence of a time-varying hyperbolic electrostatic field. This field contains both a direct current (DC) and an alternating current (AC) component. The frequency of the AC component is fixed, and the ratio of the DC voltage to the AC voltage is also fixed. Studies of the dynamics of an ion in such a field have shown that only ions of a particular charge to mass ratio will transit the quadrupole without discharging against one of the rods. Consequently, the device acts as a mass filter. The ions that successfully exit the filter may be detected. If the DC and AC voltages are ramped together, the detected signal is a spectrum of the different masses that are present in the ion flux. The largest mass that can be detected is determined by the largest voltage that can be applied.

The resolution of a quadrupole filter is determined by two main factors: the number of cycles of alternating voltage experienced by each ion, and the accuracy with which the desired field is created. So that each ion experiences a large enough number of cycles, the ions are injected with a small axial velocity, and a radio frequency (RF) AC component is used. This frequency must clearly be increased as the length of the filter is reduced. In order to create the desired hyperbolic field, highly accurate methods of construction are employed. However, it becomes increasingly difficult to obtain the required precision as the size of the structure is reduced.

The sensitivity and hence the overall performance of a mass spectrometer is also affected by the ion flux, which is also clearly reduced as the size of the entrance pupil is decreased.

Several miniaturised quadrupole mass spectrometers have been constructed. Two examples of such instruments are based on square arrays of miniaturised electrostatic quadrupole lenses and are described in U.S. Pat. No. 5,401,962 and U.S. Pat. No. 5,719,393. The advantage of using an array is that parallel operation can recover the sensitivity lost by miniaturisation. The square array geometry is particularly efficient, because an array of $N^2$ quadrupoles only requires $(N+1)^2$ electrodes.

The device disclosed in U.S. Pat. No. 5,401,962 is commercialised under the brand name "The Ferran Micropole" and is available as a high-pressure residual gas analyser. It consists of a square parallel array of nine quadrupole analysers constructed using sixteen cylindrical metal rods 1 mm in diameter and 20 mm long, mounted in miniature glass-to-metal seals. The ion source is a conventional hot-cathode device. The quadrupoles are driven in parallel by a RF generator, and the ion detector consists of an array of nine Faraday collectors connected together.

The array-type quadrupole mass spectrometer described in U.S. Pat. No. 5,719,393 was developed by the Jet Propulsion Laboratory (JPL) and has electrodes that are welded to metallised ceramic jigs. The ioniser is a miniature Nier type design with an iridium-tungsten filament. The detector can be a Faraday cup or a channel-type multiplier.

Quadrupole lens arrays smaller than the devices described above have been fabricated by exposing a photoresist to synchrotron radiation and then filling the resulting mould with nickel by electroplating, in a collaboration between JPL and Brookhaven National Laboratory and described in U.S. Pat. No. 6,188,067. The lens assembly is a planar element, which is configured into a stacked structure in the complete mass spectrometer. However, there is no evidence of successful operation of the device.

A different micro-engineered quadrupole lens has been developed jointly by Imperial College and Liverpool University, and is described in U.S. Pat. No. 6,025,591. The device 100, as shown in FIG. 1, consists of four cylindrical electrodes 115 mounted in pairs on two oxidised, silicon substrates 105, that are held apart by two cylindrical spacers 120. V-shaped grooves 110 formed by anisotropic wet chemical etching are used to locate the electrodes and the spacers. The electrodes are metal-coated glass rods that are soldered to metal films 125 deposited in the grooves.

The mounting method is similar to that used to hold single-mode optical fibres in precision ribbon fibre connectors. In each case, positioning accuracy is achieved by the use of photolithography followed by etching along crystal planes to create kinematic mounts for cylindrical components. However, in the quadrupole lens, the two halves of the structure are also self-aligning. The degree of miniaturisation is only moderate, and operation has been demonstrated using devices with electrodes of 0.5 mm diameter and 30 mm length. Wirebond connectors 135 are used to provide for electrical contact to the components of the device.

Although mass filtering has been demonstrated, the method of fabrication has some disadvantages. The electrode rods require lengthy cutting, polishing and metallisation. Because the electrodes must be metal-coated everywhere, metallisation involves multiple cycles of vacuum deposition. The bonding process used to attach the electrode rods is a time consuming manual operation, requiring axial alignment. Additional fixtures are needed to hold the assembly together, and there is no axial alignment of the two substrates, which may slide over each other.

The method of fabrication also results in some important performance limitations. The oxide layer is electrically leaky, so that the drive voltage (and thus the mass range) is limited. As a result, current device performance is insufficient for applications requiring measurement of large masses (e.g. drugs or explosives detection).

There is also significant capacitance coupling to the resistive substrate, which rises as the RF frequency is increased. The device therefore forms a poor RF load, and the mass selectivity is limited. Resistance heating in the substrate also tends to melt the solder, causing the rods tend to detach from the V-grooves.

In addition, the construction forms only a mass filter, and an ion source and detector must also be added to form a complete mass spectrometer. These elements require components for creation and detection of ions, and also for accelerating and focusing ions.

There is therefore a need to provide an improved mass spectrometer device, which can be easily fabricated. There is a further need to provide an array-type device, which could be used to increase the currently low instrument sensitivity.

OBJECT OF THE INVENTION

It is an object of the present invention to provide an improved mass spectrometer.

SUMMARY OF THE INVENTION

Accordingly the present invention provides an integrated mass spectrometer device. In a wafer-scale batch fabrication process, a plurality of similar dies are formed on two multilayer wafers, each wafer having an inner layer, an outer layer and having an insulating layer provided therebetween. Alternatively, in a small-scale fabrication process, a single device is formed from two dies taken from a single multilayer wafer. The two approaches are similar and in the following description "die" may be substituted for "wafer" without alteration of the general meaning. The device is provided with a plurality of electrode rods and a plurality of electrodes, the electrodes and electrode rods being formed on distinct layers of the wafers.

The spectrometer is desirably a quadropole mass spectrometer and the invention additionally provides a method of constructing such a micro-engineered quadrupole mass spectrometer, which overcomes many of the difficulties associated with the above prior art. Such a quadropole device requires at least four electrode rods, typically cylindrical with each rod having its diameter and centre-to-centre separation correctly chosen for quadrupole operation.

The horizontal separation of the cylindrical electrodes within each wafer is desirably defined by lithography and deep reactive ion etching.

The vertical separation of the cylindrical electrodes is typically defined by the combined thickness of the two inner layers, which are bonded together during the fabrication process.

Ignoring additional coatings, each of the multilayer wafers desirably has three layers, which are combined to form a five-layer structure.

The electrode rods preferably are mountable in the outer layers of each wafer. Desirably the rods are cylindrical electrode rods and are made from metal, thus simplifying electrode preparation.

The outer layers of each wafer are suitably dimensioned to receive the electrode rods therein, the electrode rods being retained in contact with the outer layer by the provision of at least one resilient member formed in the outer layer. Such retention is desirably provided by mounting the electrode rods in etched slots within the wafers and retaining them therein using silicon springs, thus simplifying assembly, avoiding the need for bonding material, and reducing the likelihood of detachment. The slots and springs are typically etched in bonded silicon-on-insulator substrates, using deep reactive ion etching. The precision of the assembly is determined by a combination of lithography and deep etching, and by the mechanical definition of the bonded silicon layers.

Each of the first and second wafers is typically patterned with an outer pattern on a first side, and an inner pattern on a second side. The use of both sides of each wafer is thereby enabled.

The patterns provided on the second side typically provide for ion source and ion collection components of the spectrometer, which may be used together with components for accelerating, focusing or reflecting the ions The insulating layer is desirably provided in regions where the patterns overlap.

The first and second wafers are typically bonded to form a monolithic block. The bonding is desirably effected in such a manner that the electrode rods are located on an outer portion of the block and the electrodes in an inner portion of the block.

At least some of the plurality of electrodes are desirably adapted to form ion entrance optics. These ion entrance optics are typically formed by an einzel lens.

At least some of the plurality of electrodes are desirably adapted to form ion exit optics. These ion exit optics may also be operated in a mode that reflects a desired fraction of ions, thus enabling operation as a linear quadrupole ion trap such as that described in WO 97/47025 in addition to operation as a linear quadrupole mass filter. One of the plurality of electrodes may in addition be adapted to form an ion collector.

A hot cathode electron source may be provided in front of the ion entrance optics for the purpose of ion creation by electron impact. In another embodiment, a cold cathode field emission electron source may be provided in front of the ion entrance optics for a similar purpose. It will be understood that the choice of electron source used will typically be determined on the basis of the type of ion fragmentation required and that some types of sources may be chosen as being more appropriate for one type of fragmentation than other types.

In another embodiment, a pair of RF electrodes is placed in front of the ion entrance optics in order to create a plasma from which ions may be extracted.

In a further embodiment, a pair of electrodes is placed in front of the ion entrance optics and used with DC voltages in order to create a glow or corona discharge from which ions may be extracted.

In a further embodiment, the ion entrance optics are formed from an etched fluid channel combined with a set of electrodes that together define an electrospray source of ions.

Two or more devices may be combined to form an array which may be formed either as a plurality of devices formed in parallel or in series. When arranged in parallel, it will be appreciated that the array forms multiple quadrupole filters having greater total ion throughput and greater measurement accuracy. When arranged in series, the array forms a tandem mass spectrometer, having more complex measurement possibilities. This configuration may include a pair of electrodes provided between each pair of the devices in the series so as to form a plasma The invention additionally provides a method of forming a mass spectrometer comprising the steps of:

etching an inner and outer pattern on a wafer, the inner and outer patterns defining components for the spectrometer, bonding the wafer to a second wafer so as to form a multilayer stack device, inserting at least one electrode rod into the device. The at least one electrode and one electrode rod are desirably formed on distinct layers of the wafer.

It will be appreciated that the quadrupole geometry is achieved using two substrates, which are aligned and bonded into a single block using a bonding tool. The formation of a monolithic block increases the rigidity and reliability of the device. No additional components are required to align the structure or hold it together. The mounting of electrodes on the outside of the two substrates ensures that it is easier to access and position the electrodes. Electrical isolation is desirably provided by thick layer of high quality silicon dioxide, thus minimising leakage and maximising the voltage that can be applied. The majority of the silicon around the rods is typically removed, thus minimising capacitance coupling and maximising the usable frequency.

Ion coupling optics and other features such as fluidic channels may be incorporated in the structure. Because the electrodes are located on the outside of the block, it is simple to construct an array device. Cascaded devices such as tandem mass spectrometers may be constructed in a similar way.

These and other features of the present invention will be better understood with reference to the drawings and description thereof which follow.

DETAILED DESCRIPTION OF THE DRAWINGS

Figure 1:
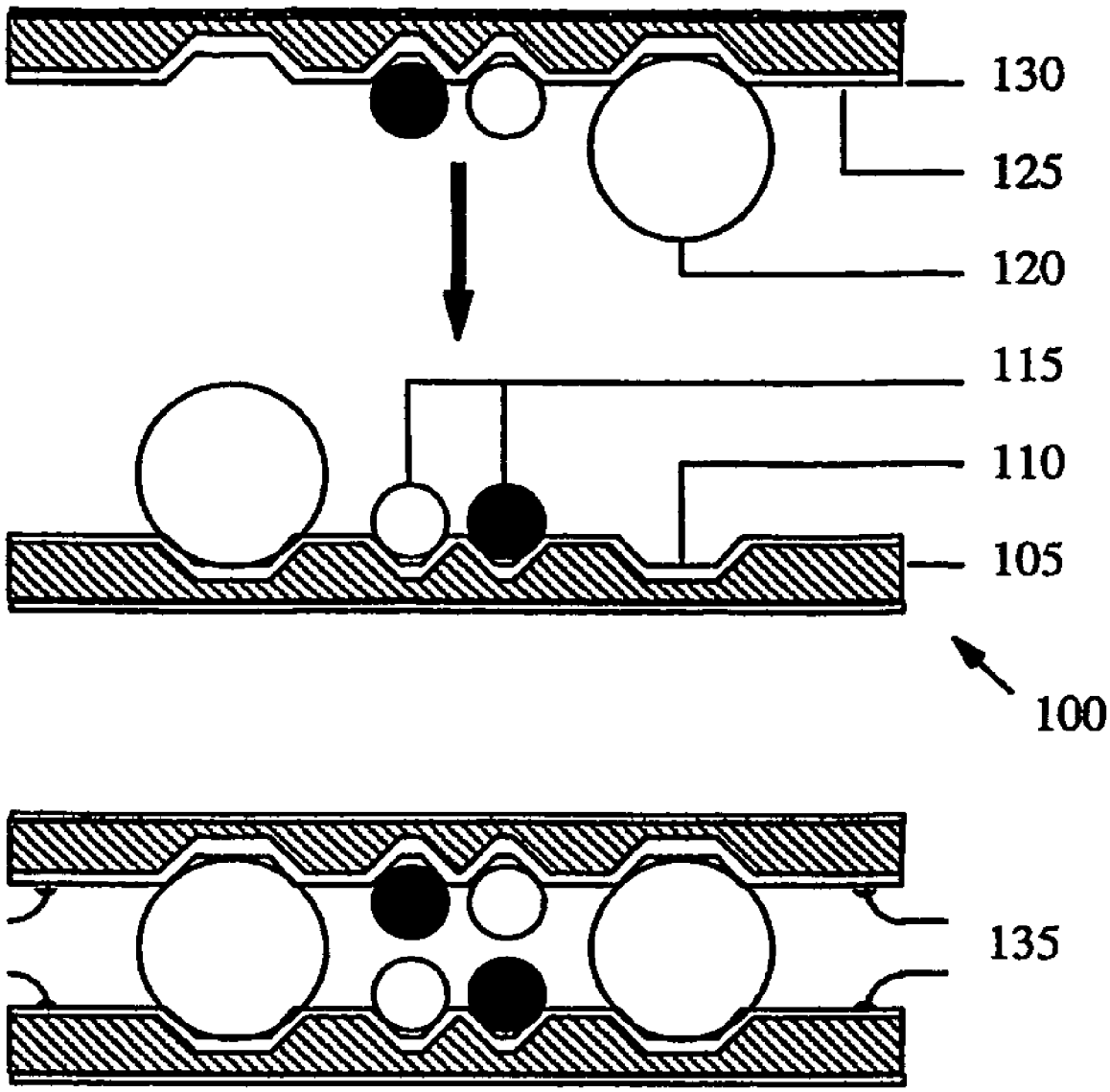
FIG. 1 shows a prior art micro-engineered quadrupole electrostatic lens.

FIG. 1 has been described with reference to the prior art.

The present invention will now be described initially with reference to FIGS. 2–6, which show an example of a new method of construction, based on deep-etched features formed in bonded silicon-on-insulator (BSOI) material, according to a preferred embodiment of the invention. BSOI consists of an oxidised silicon wafer, to which a second silicon wafer has been bonded. The second wafer may be polished back to the desired thickness, to leave a silicon-oxide-silicon multi-layer. BSOI wafers typically find application in high-voltage microelectronics. However, the different layers in the wafer may also be processed using semiconductor microfabrication techniques to yield a three-dimensional structure. Further embodiments or modifications are illustrated with reference to FIGS. 7 to 11.

Figure 2:
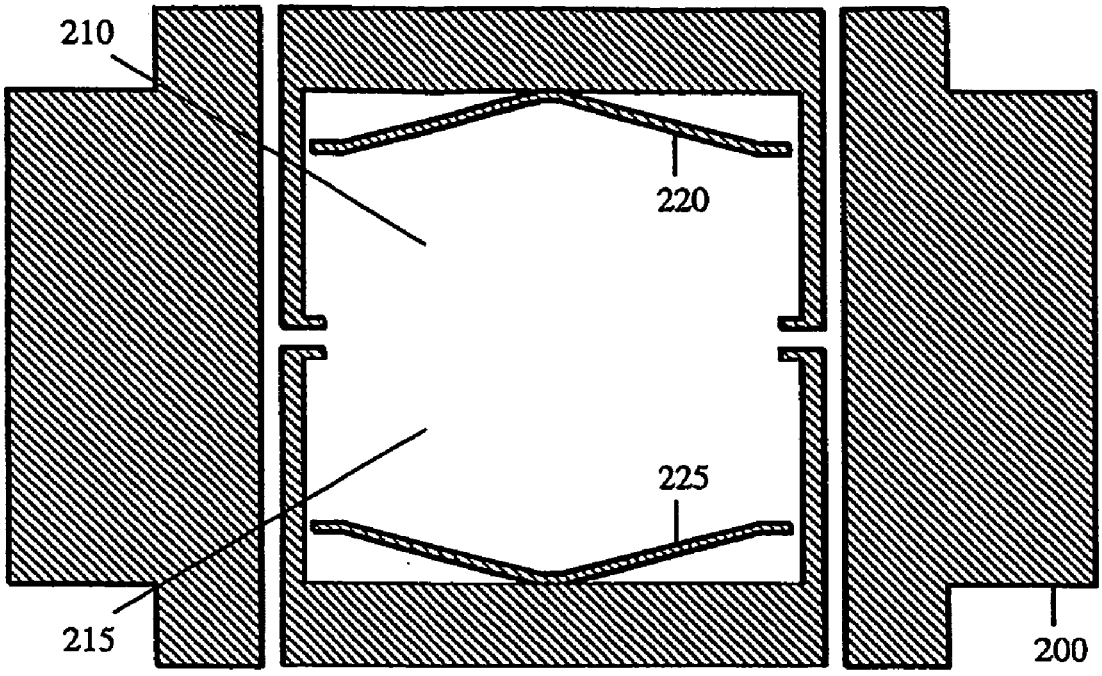
FIG. 2 is a plan view showing a) the outer and b) the inner etched patterns in a monolithic, micro-engineered mass spectrometer according to the present invention.
Figure 2:
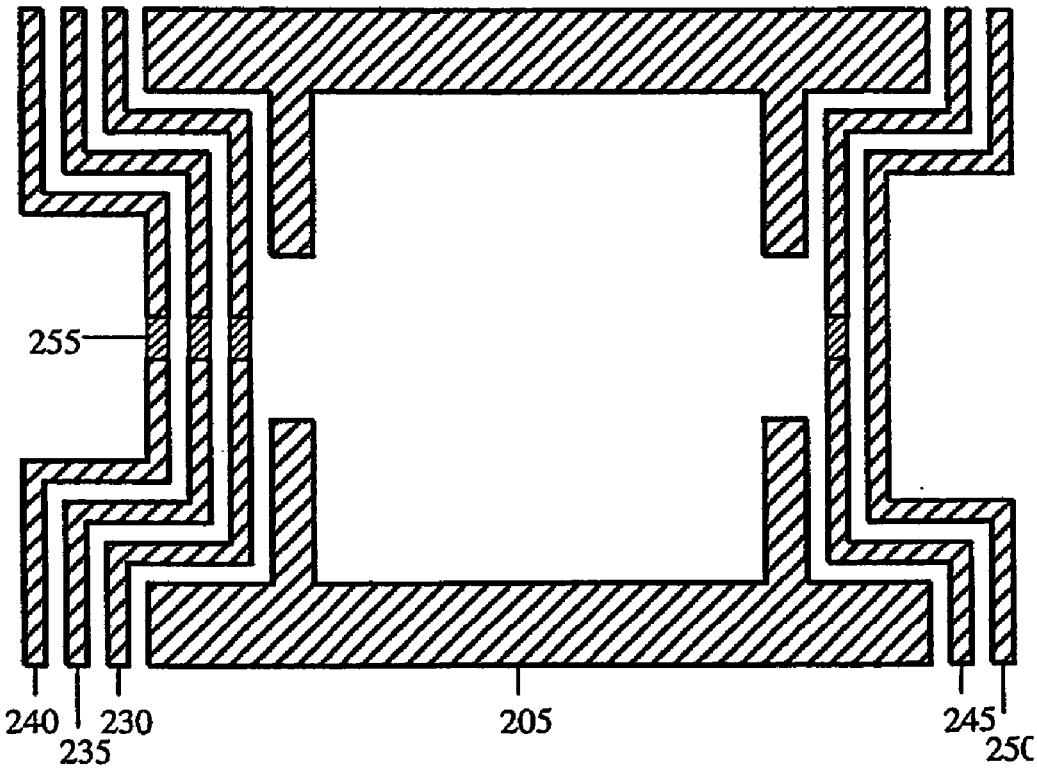
Figure 3:
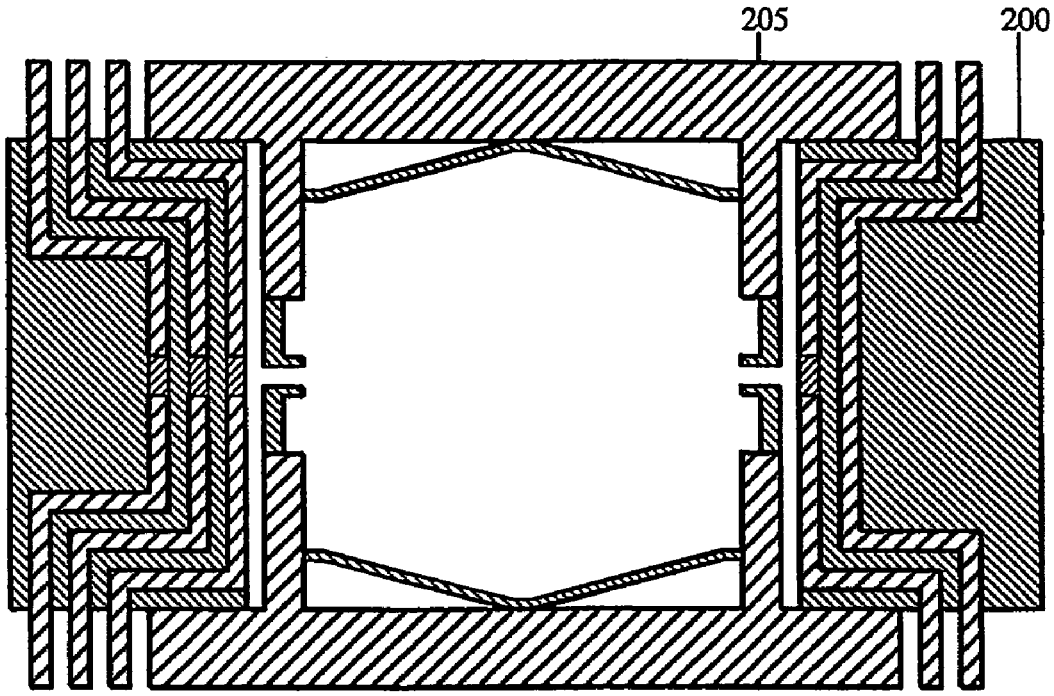
FIG. 3 is a plan view showing a) the registration of the outer and inner pattern, and b) the location of the electrode rods by the outer pattern in a device according to the present invention.
Figure 3:
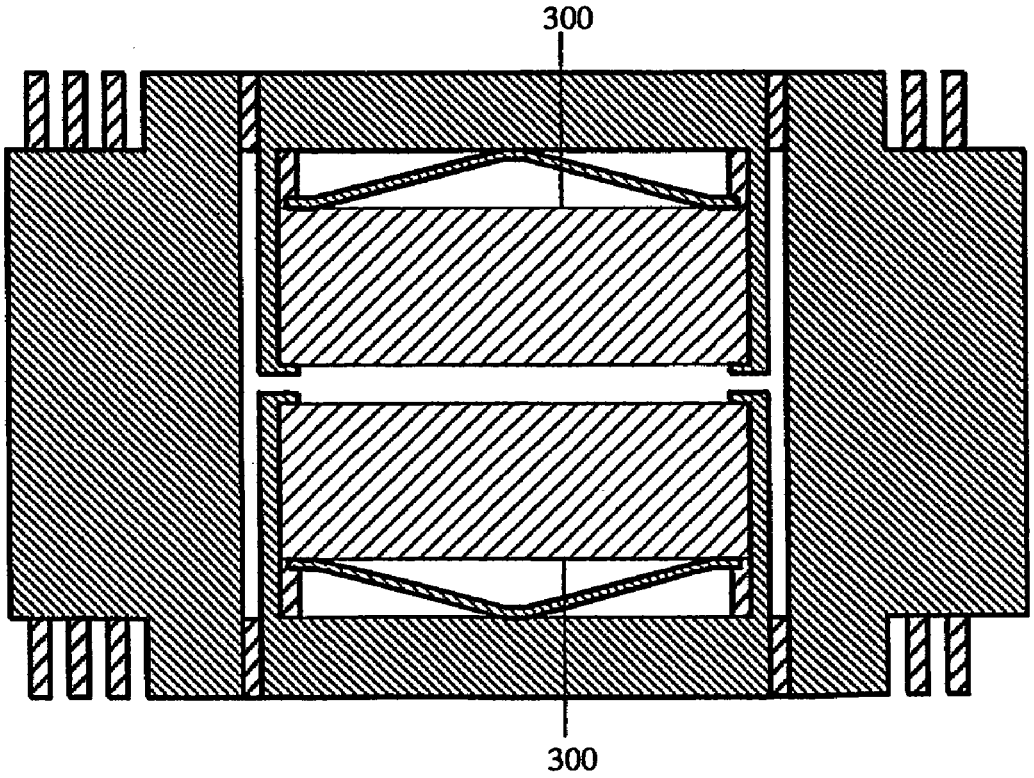
Figure 4:
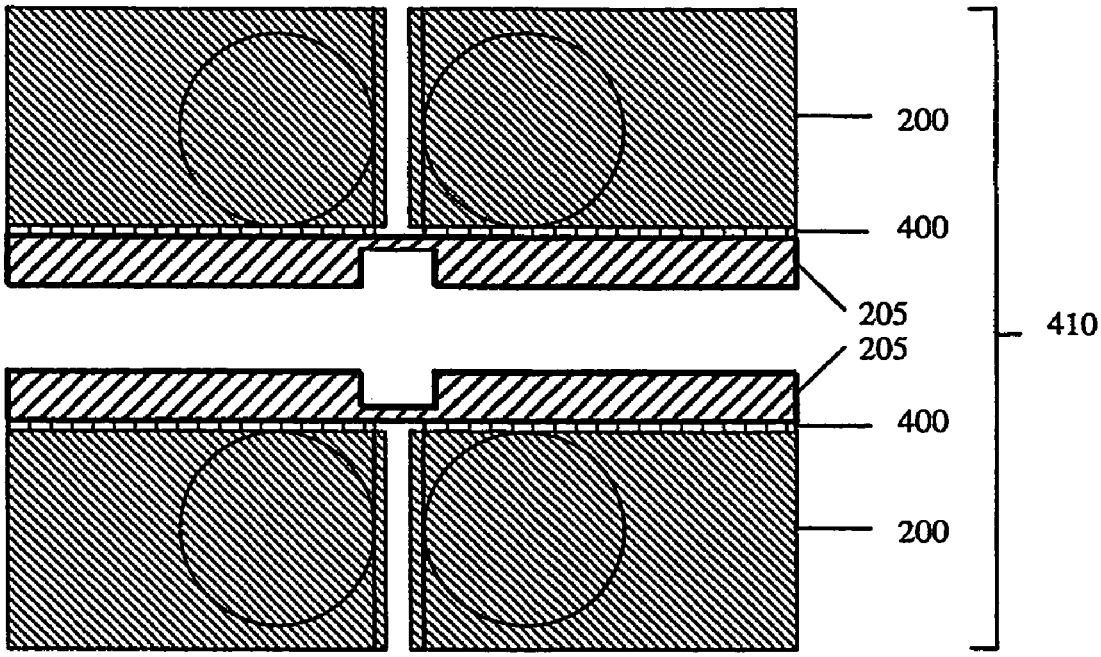
FIG. 4 is a cross-sectional view, showing a) wafer bonding and b) electrode rod insertion of the device of FIG. 3.
Figure 4:
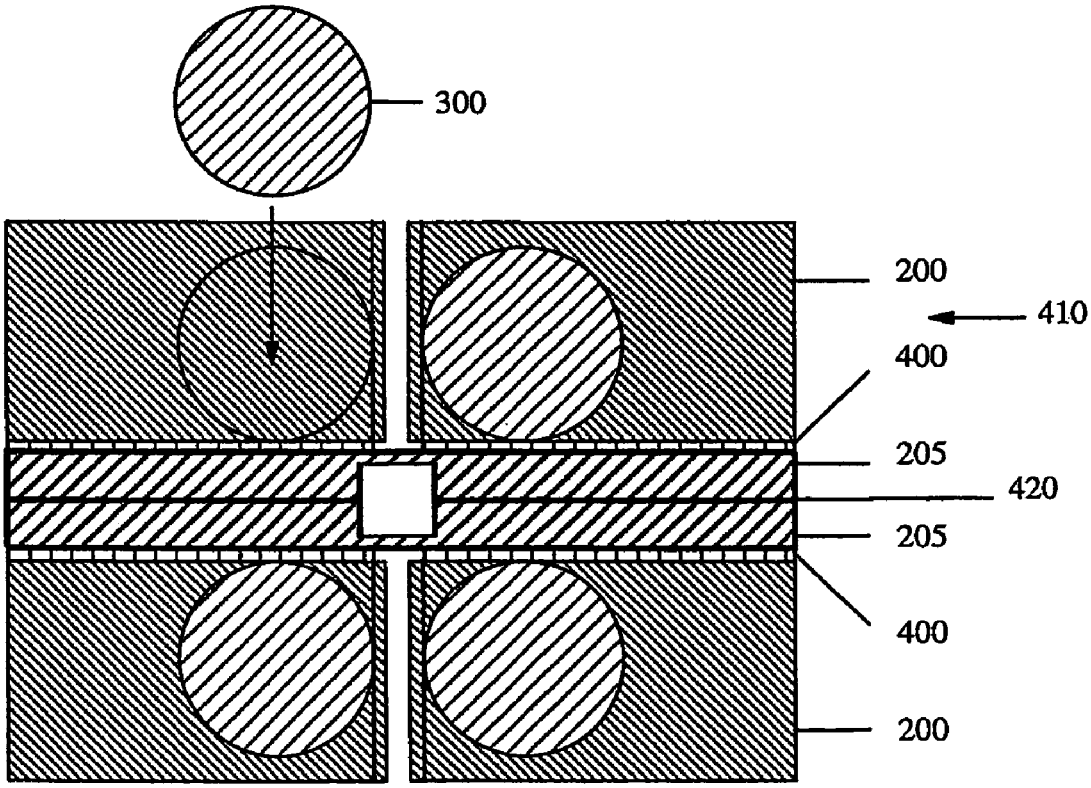

In accordance with the present invention two BSOI wafers are required, each with a double-side polish. Alternatively, two dies from the same wafer may be used in a small-scale process. FIG. 2 shows how each wafer may be patterned with an outer pattern on the first side 200 (FIG. 2*a*) (the original substrate wafer side), and an inner pattern on the second side 205 (FIG. 2*b*) (the bonded wafer side). The features are desirably made by deep reactive ion etching (DRIE), a process used to form near vertical trenches with very high precision.

The pattern is transferred into the silicon from a shallower surface mask layer, which is resistant to the reactive species commonly employed in deep reactive ion etching. Suitable mask materials are thick layers of hard-baked photoresist and silicon dioxide. The first steps of processing therefore involve deposition and patterning of the mask layers. Photoresist may be spin-coated and patterned by photolithography. Silicon dioxide may be formed by thermal oxidation or coated by chemical vapour deposition. It can be patterned by reactive ion etching, using a thinner layer of photoresist as a mask.

There is considerable flexibility in the patterns that may be used. The following description, with reference to FIG. 2 to 6, corresponds to an exemplary embodiment that illustrates the advantages of the constructional approach provided by the present invention and the differences from the prior art previously described, and it will be appreciated by those skilled in the art that modifications to the specific pattern described may be effected without departing from the scope of the invention. Further aspects are illustrated in FIGS. 7–11.

FIG. 2*a* shows a plan view of the outer pattern 200. This pattern is adapted to provide for the retention of electrodes and in this illustrated embodiment consists of a set of locating features 210, 215 for two cylindrical electrode rods (not shown), and two flexible members which are shown as springs 220, 225 to retain the rods in place. The rod diameters are comparable to the thickness of the wafer.

FIG. 2*b* shows a plan view of the inner pattern 205. At the left-hand end, this pattern consists of a set of three electrodes 230, 235, 240 that can act as an einzel lens, a common electrostatic optical component that is used to focus charged particles into an electron or ion optical system. At the right-hand end, this pattern consists of a similar (but not identical) set of two electrodes 245, 250 that can act as a Faraday cage and an ion collector at the exit of the system. In effect, the first and second sets of electrodes form the ion source and ion counter—the entrance and exit optic pupil components of the spectrometer device.

The patterns may be etched through the entire thickness of the bonded layer. Alternatively, more complicated processing involving two mask layers may be used to limit the depth of the pattern in some areas. For example, a small thickness of the silicon may be left linking the upper and lower electrodes in the einzel lens and the Faraday cage, as shown by the fine shading 255 in FIG. 2*b*. It will be appreciated that this process may be achieved using a number of different techniques such as delayed shadow masking. Certain other techniques provide for some parts of the electrode pattern to be continued into the layers beneath.

FIG. 3*a* shows the relationship of the outer and inner patterns. In some areas, additional features are added to the outer pattern to ensure mechanical continuity between the two layers, so that the overall structure is rigid. In other areas, the outer layer pattern is cut away, so that all the electrodes may be accessed from the outer side of the structure. The two patterns may be registered together with high accuracy using a double-side mask aligner.

FIG. 3*b* shows the eventual location of cylindrical electrode rods 300 within the outer layer pattern. The locating springs 220, 225 hold the two rods so that they are symmetrically displaced on either side of an optical axis defined by the entrance and exit optic pupils formed by the patterns on the inner layer. The springs also make electrical contact to the electrode rods.

As shown in the sectional view of FIG. 4*a*, an oxide interlayer or insulating layer 400 is provided between the inner and outer layers of each wafer. After deep reactive ion etching, the oxide interlayer is partially removed by wet chemical etching, to leave oxide remaining only in the regions where the patterns in the inner and outer layers overlap. It will be appreciated that certain applications may require the addition of additional oxide insulation to be provided over the structure by thermal oxidation, or by a coating process such as chemical vapour deposition. Further processing is then used to provide metal contacts to each silicon electrode in the entrance and exit optical system, and to the silicon springs that retain the cylindrical electrodes. Because the contacts may all be accessed from the outer layer of the structure, this metal may be added by single-sided vacuum deposition. Alternatively, a conformal coating process such as sputter deposition may be used to provide a metal coating to all the silicon parts.

Once each of the two wafers has been patterned they may be aligned together and bonded. Ignoring additional coatings such as metals, this process will leave a silicon-oxide-silicon-oxide-silicon multilayer stack 410, as shown in the cross-sectional view of FIG. 4*a*. It will be appreciated that each wafer comprises three layers; the outer and inner layers and an isolation layer provided therebetween. In the bonding process each of the inner layers are integrally bonded to form a bond interface 420, such that in the complete stack only five distinct layers are present. It will be understood that the five distinct layer arrangement just described does not include the additional coatings that may be present on each or one of the individual layers making up the stack. The alignment and bonding may be carried out using a variety of techniques such as a bonding tool equipped with a microscope and mechanisms for compression and heating. Additional bonding agents such as solder materials may also be used. The resulting composite wafer is then diced to separate the individual dies. At this stage, each device is a single rigid, monolithic block. Each device is then attached to a submount, and wirebond connections are made to the contact metallisation.

Metallic electrodes 300, desirably cylindrical, are then inserted into the block 410 from the outside, as shown in the cross-sectional view of FIG. 4*b*. In the example of a quadrupole spectrometer, four electrodes are utilised and the four electrodes have their diameters and centre-to-centre separations chosen for quadrupole operation. The horizontal position of each electrode is defined by the locating features and springs etched into the outer layer pattern. The vertical separation of the electrodes is defined by the thickness of the two inner bonded silicon layers, which may be accurately specified in commercially available BSOI material.

Figure 5:
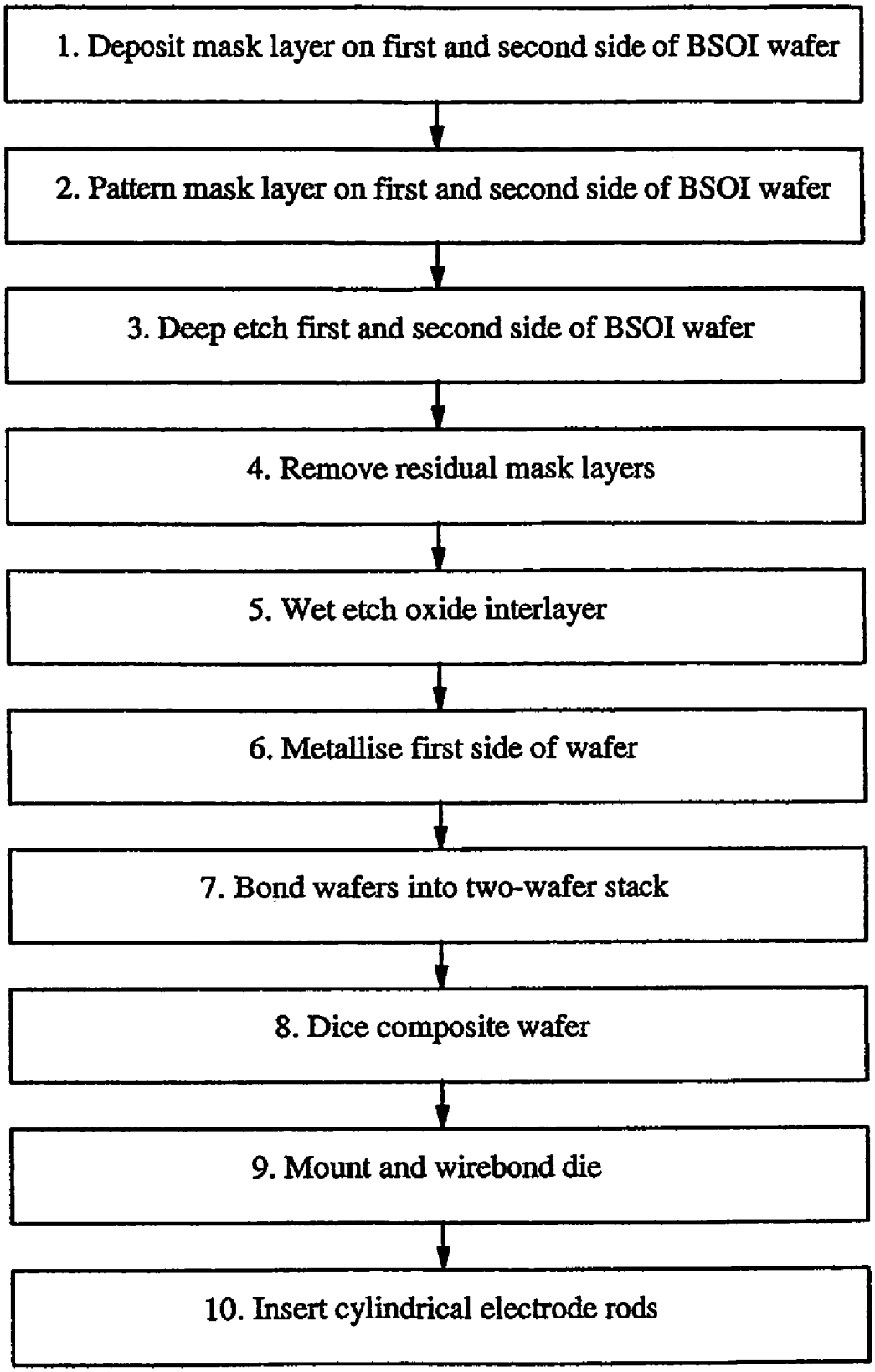
FIG. 5 is a simplified flow chart showing the fabrication steps involved in the construction of a monolithic, microengineered mass spectrometer according to the present invention.

The fabrication process above is summarised in FIG. 5. This figure shows the steps of (1) depositing a mask layer on the first and second sides of a wafer; (2) patterning the mask layer on the first and second sides; (3) deep reactive ion etching of the first and second sides of the wafer; (4) removal of residual portions of the mask layer; (5) wet etching of the oxide interlayer; (6) metallisation of the first side or both sides of the wafer; (7) bonding of two wafers into a two-wafer stack; (8) dicing of the resulting composite wafer; (9) mounting and wirebonding of individual dies, and (10) insertion of cylindrical electrode rods. It will be understood that variations in the process steps or the order of their use may also achieve a similar result, and it is not intended to limit the present invention to any one sequential set of steps.

Figure 6:
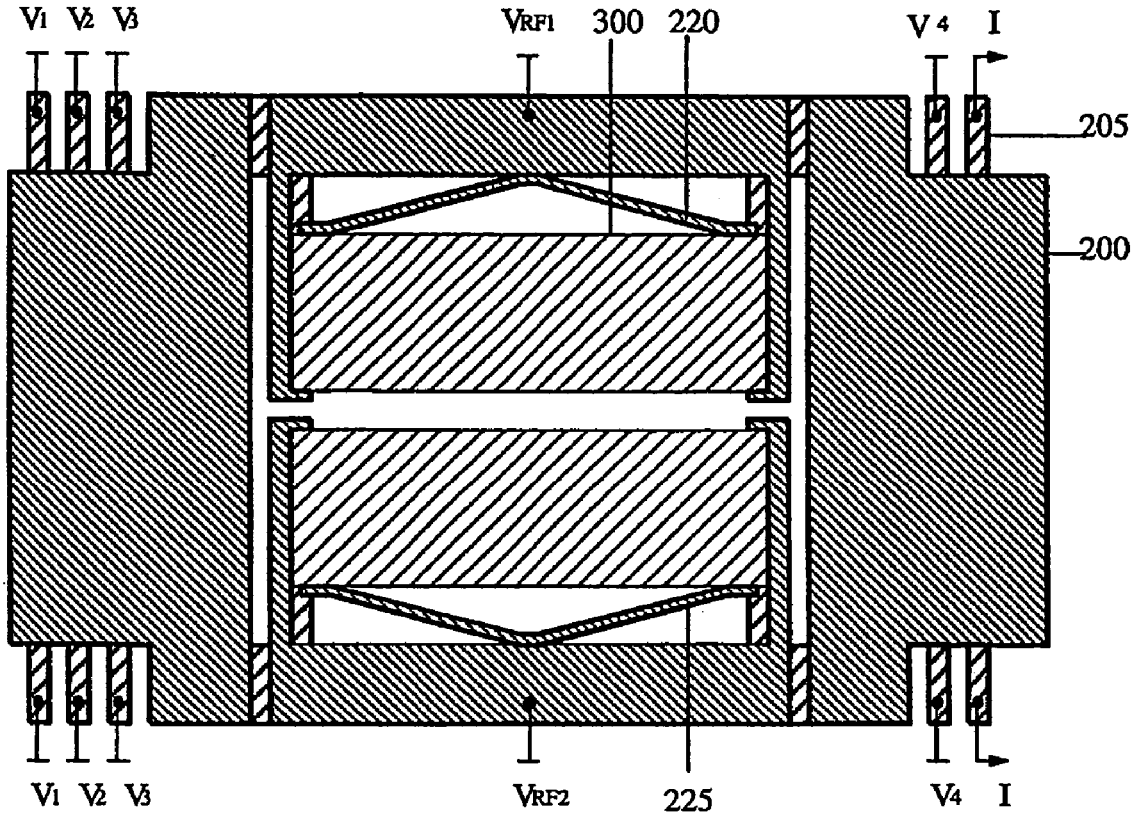
FIG. 6 is a schematic illustrating electrical connections to a monolithic, micro-engineered mass spectrometer according to the present invention.
Figure 7:
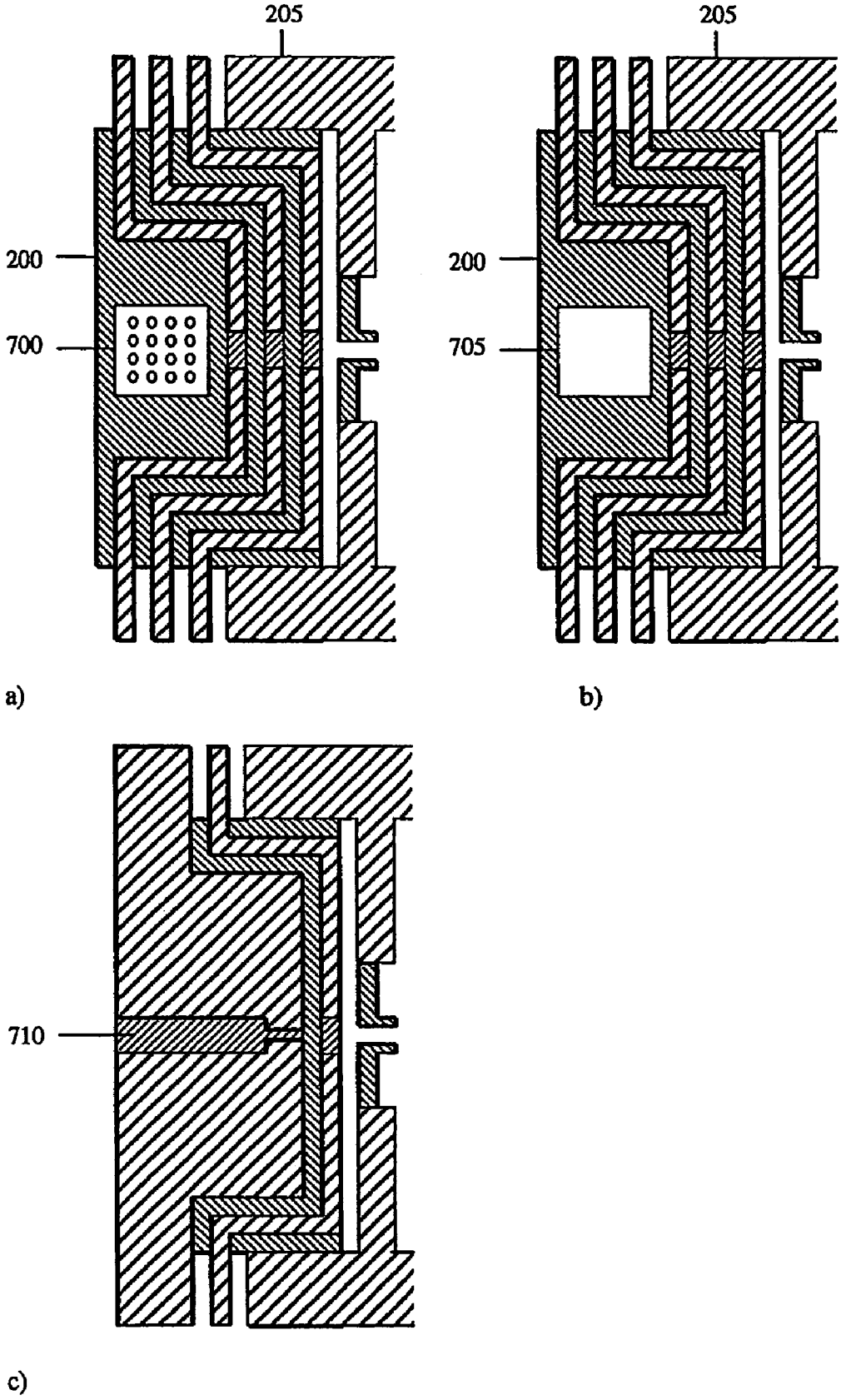
FIG. 7 is a schematic showing the location of a) a cold cathode field emission electron source, b) an RF plasma source and c) an electrospray source at the input to a monolithic, micro-engineered mass spectrometer according to preferred embodiments of the present invention.

Electrical connections to the device are made as shown in FIG. 6. DC voltages $V_1$, $V_2$ and $V_3$ are applied to the einzel lens electrodes and $V_4$ to the Faraday cage. Voltages $V_{RF1}$ and $V_{RF2}$ containing both a DC and an AC component are applied to the cylindrical electrodes. The DC and AC components have the ratios commonly used in quadrupole mass spectrometers to provide mass filtering. The ion current I is collected from the electrode to the right of the Faraday cage and passed to a transimpedance amplifier (not shown).

In an alternative configuration, the integrated ion collector may be omitted and an external detector such as a channel-type multiplier may be used.

The electrodes provided in the description above are suitable for coupling an ion flux into the quadrupole assembly, performing a mass filtering operation, and detecting the resulting filtered stream of ions. Further components are required to create the ion flux. FIGS. 7*a* and 7*b* show modifications to the previous structure so as to optimise the performance for gaseous analytes. FIG. 7*c* shows a modification appropriate for liquid analytes, For a gaseous analyte, ionisation may be carried out by electron bombardment. A suitable electron stream may be provided by a cold-cathode field emission electron source, fabricated as a planar array of Spindt emitters 700. The source may be located (for example, by hybrid integration) on an etched silicon terrace, immediately in front of the ion input coupling optics as shown in FIG. 7*a*. The source is arranged to emit electrons in a direction perpendicular to the main axis of the mass spectrometer, so that the electron and ion streams may be efficiently separated.

Alternatively, the electron source may be located outside the device, and electrons may be injected through a mesh-shaped or alternatively shaped or dimensioned opening. An advantage of a mesh-shape is that this configuration allows the ions to be created within an equipotential source cage.

Alternatively, ionisation may be carried out within a gas plasma, which itself may be created by an RF electric field 705, as shown in FIG. 7*b*. The field may be established between a pair of electrodes located on etched silicon terraces, located immediately in front of the ion input coupling optics. Again, the RF field is arranged to accelerate electrons in a direction perpendicular to the main axis of the mass spectrometer, so that the electron and ion streams may be efficiently separated.

Alternatively, ionisation may be carried out within a DC discharge, which may be created by a similar pair of electrodes carrying DC potentials.

A relatively high pressure is required to sustain a plasma or a DC discharge. This pressure is not normally compatible with mass filter operation, since the mean free path is too short. However, the ability to create sealed or partly sealed chambers by bonding two wafers as described in this invention allows the construction of a differentially pumped system, in which the source chamber operates at high pressure and the mass filter at low pressure.

For a liquid analyte (for example, as provided by a liquid chromatography column), ionisation may be carried out within an electrospray source, A suitable source may be constructed by using an etched capillary channel 710 located immediately in front of the ion input coupling optics as shown in FIG. 7*c*. Liquid may be extracted from such a channel as a stream of charged droplets by a nearby electrode held at a sufficiently large DC potential.

It will be appreciated by those skilled in the art that all of the above may be implemented using the process described in FIG. 5, or by modifications thereto that either involve simple alterations to the layout of the etched structures, or that require additional steps of metal and oxide deposition, patterning and etching.

It will be appreciated that although it has been described with reference to the formation of distinct devices that the fabrication approach described above (namely, the use of patterning, deposition and etching to create a number of similar structures on a semiconductor wafer) may clearly be extended to create parallel arrays of devices in close proximity, which may act as an array-type mass spectrometer. The quadrupole lenses may be driven in parallel, and the ion currents summed, to obtain an increase in instrument sensitivity. Alternatively, the quadrupole lenses may be driven separately, and the ion currents measured separately, to obtain a separate measure of a number of different ion species.

Figure 8:
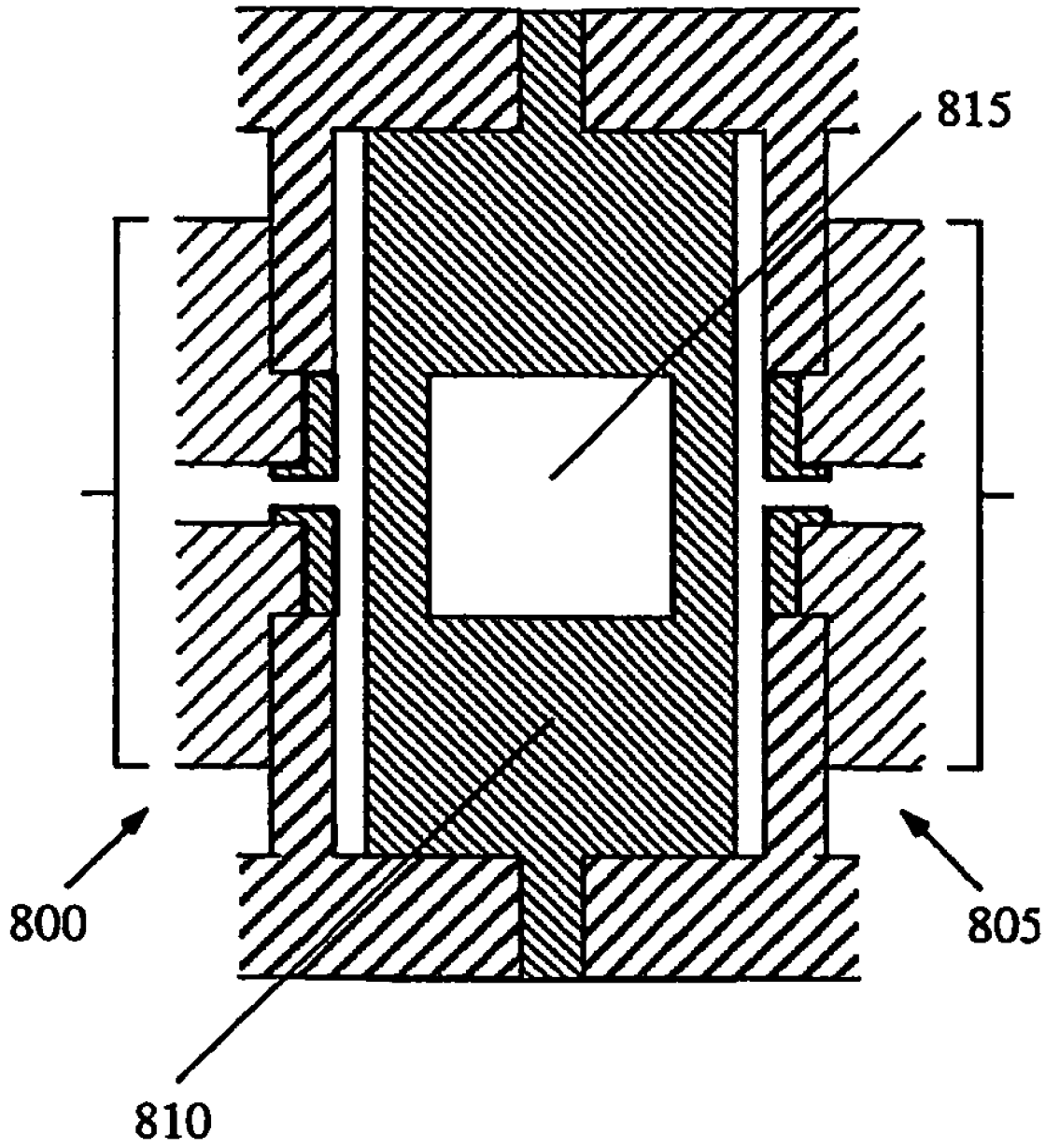
FIG. 8 is a schematic showing the location of a collision chamber between cascaded quadrupole lenses, as required in tandem mass spectrometry.
Figure 9:
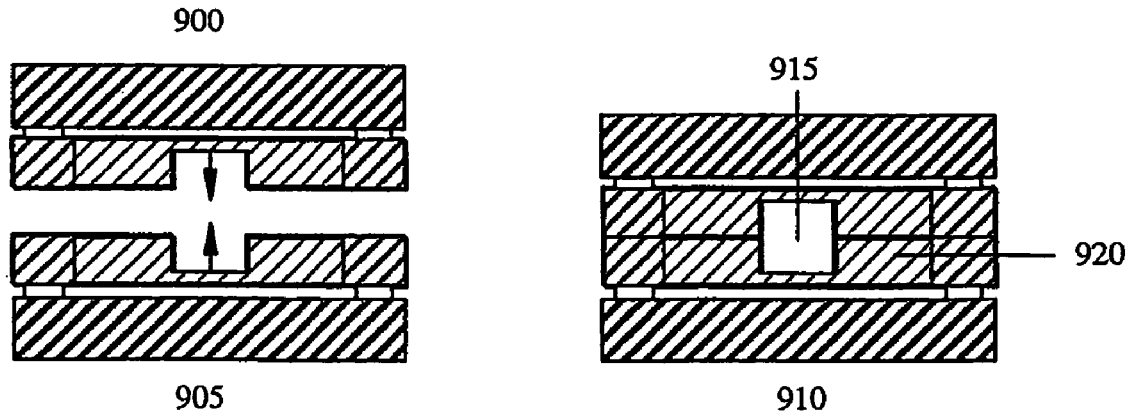
FIGS. 9*a* and 9*b* shows the assembly of two etched parts to form an electrostatic element based on apertures and on apertures covered by one-dimensional meshes.
Figure 9:
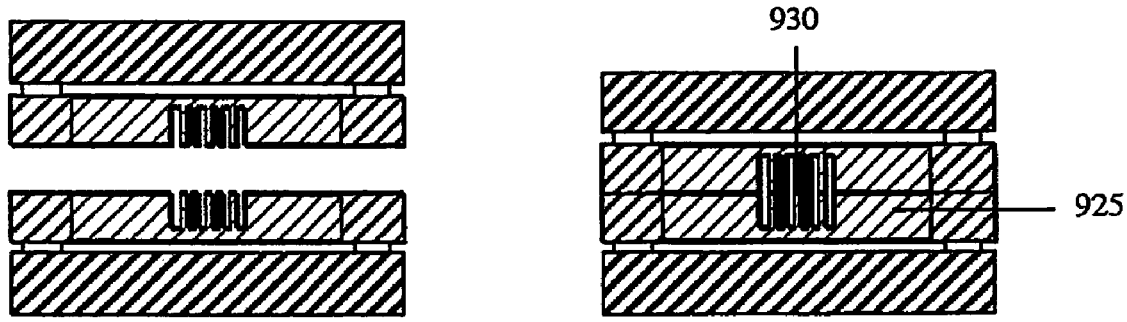
Figure 10:
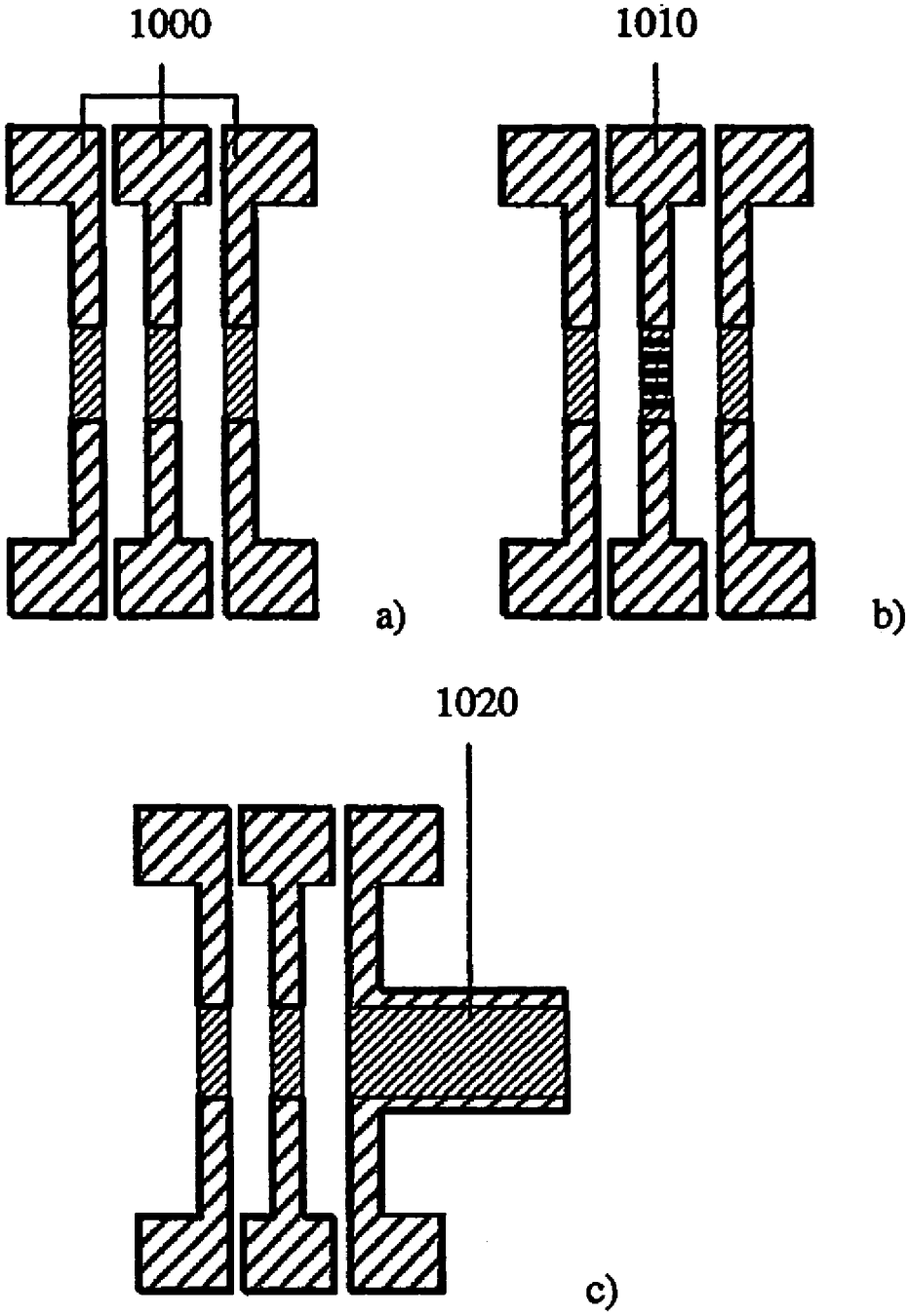
FIGS. 10*a*, 10*b* and 10*c* show plan views of the pattern required on one substrate to construct three-element electrostatic lenses, using different combinations of apertures, tubes and meshes.

The fabrication approach described above may also be extended to create serial arrays of devices in close proximity, which may provide advanced functionality. For example, FIG. 8 shows two quadrupole lenses 800, 805, which are connected in series to act as a tandem mass spectrometer. The first quadrupole 800 may be set to pass only those ions that have masses in a particular range, thus acting as a prefilter. The selected ions may be fragmented in a collision chamber 810, and passed to the second quadrupole 805 for further analysis.

The collision chamber 810 is desirably a small volume within which a plasma may be created by excitation of an inert gas (for example, argon) using a pair of RF electrodes 815. The construction of a collision chamber using the methods described above merely involves additional steps of metal and oxide deposition, patterning and etching. Differential pumping may again be employed to allow this chamber to operate at a higher pressure than the quadrupole filters. These additional steps will be apparent to those skilled in the art.

It will be understood that the formation or provision of complex electrodes and/or electrostatic elements may require specific multi-level processing such as that provided by multiple surface mask layers. In such techniques, two or more masks are used in combination with one another to provide for a complex patterning of the base silicon material so as to provide the desired physical configurations.

FIG. 9*a* shows how such multilevel features may be used to construct an electrode suitable for controlling charged particles such as ions or electrons. Two wafers 900, 905 (or alternatively two dies) are shown, and the complete electrode 910 is constructed by bonding the two wafers together. The features that have been partially etched combine to yield an aperture 915 formed in a planar diaphragm electrode 920 defined by the fully etched features. FIG. 9*b* shows how this concept may be extended to form an electrode 925 consisting of an aperture covered by a one-dimensional mesh 930. In this case, the first mask layer must be patterned to leave a set of closely spaced strips in the vicinity of the aperture.

Electrode structures formed in this way may be used to construct a variety of lens elements and electrostatic devices. For example, three apertured diaphragms 1000 may be used to form an einzel lens, as shown in FIG. 10*a*. Alternatively, the central diaphram may be replaced by a mesh 1010 as shown in FIG. 10*b*. This configuration allows stronger focusing or stronger reflection. Finally, any or all of the three electrodes may be extended axially to form a tube 1020 with a rectangular or square cross-section, as shown in FIG. 10*c*.

The last configuration is particularly advantageous in a quadrupole device as described in the present invention. Near the entrance and exit of the quadrupole lens, the electric field is distorted by the presence of nearby structures used to support and locate the cylindrical electrode rods. A tube-shaped electrode may advantageously be employed at either end of the quadrupole to shield the ions from these field imperfections.

Figure 11:
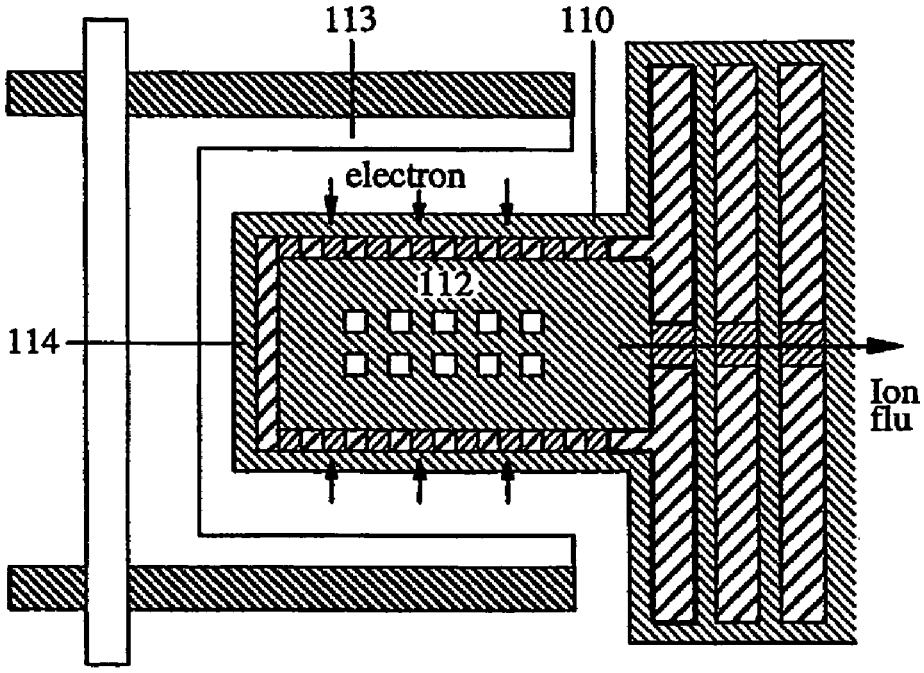
FIGS. 11*a* and 11*b* show plan views of hot-cathode ion sources constructed using external and integrated filaments.
Figure 11:
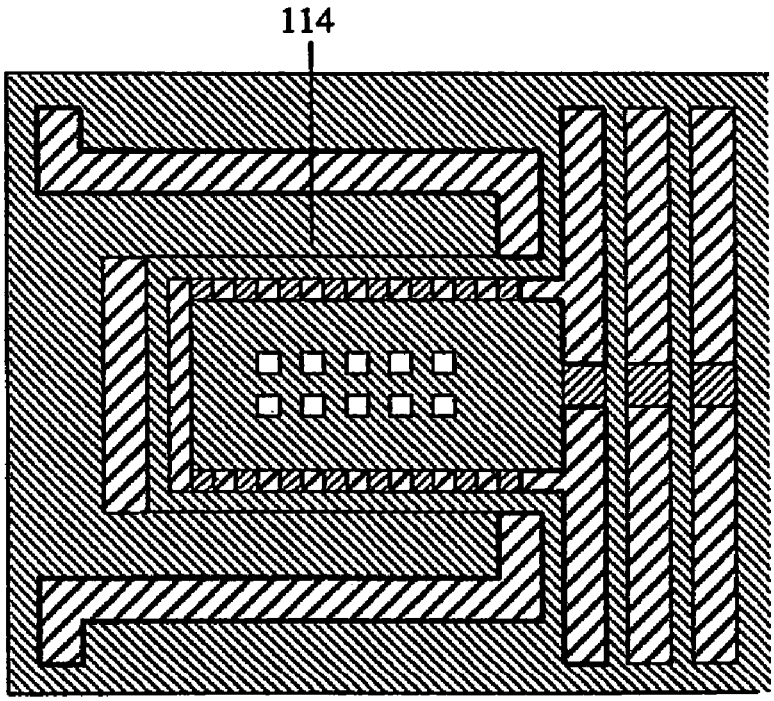

FIG. 11 shows further uses of multilevel processing to form components of a mass spectrometer system. In FIG. 11*a*, a mesh element 1100 is used to define part of the perimeter 1110 of a source cage 1120 into which electrons are injected from an external filament 1130. In FIG. 11*b*, a similar structure containing an integrated filament 1140 which is also formed by etching. In another configuration, a removable filament formed by etching may be used. It will be appreciated that there are many other possible arrangements of such structures, and these examples are not exhaustive.

As mentioned above, at least some of the plurality of electrodes may be adapted to form ion exit or entrance optics adapted to operate in a mode that reflects a desired fraction of ions. Such a configuration of ion reflectors may be used to provide an ion trap.

In operation, ions would be introduced into the mass filter portion of the spectrometer, and then by reversing the voltages applied to entrance or exit optics, the ion within the filter would be continually reflected up and down the filter, thereby being trapped and further filtered until the voltages applied to the optics were changed to enable the ions to escape from the trap or until the ions escape by virtue of energy acquired from the filter itself.

It will be understood that the arrangement of electrodes at both the entrance and exit of the mass filter portion can be configured in one of a plurality of different arrangements. For example, a three electrode structure could be provided in which the two outer elements are provided with the same voltage. In such an arrangement, an ion will have substantially the same potential on either side of the lens so that the system operates predominately in a single-potential fashion. Such arrangements are typically known as einzel lens arrangements. In other arrangements different numbers of electrodes could be provided so as to provide alternative lens structures or configurations. It will be understood that the number of electrodes or voltages applied to individual electrodes may differ, depending on the application to which the system is being applied, and it is not intended to limit the present invention to any one arrangement.

The present invention provides a mass spectrometer that is advantageous over prior art devices. Utilising a device according to the present invention it is possible to provide for more complex mass analysis than was hereintobefore possible by cascading filters, typically quadrupole filters. The device of the present invention is also advantageous in that it enables the connection of a quadrupole filter to fluidic devices containing etched channels, such as in a gas or liquid chromatography system (for example, as in a gas chromatograph mass spectrometer or GC-MS system), so as to extend the range of applications of such devices.

The words "comprises/comprising" and the words "having/including" when used herein with reference to the present invention are used to specify the presence of stated features, integers, steps or components but does not preclude the presence or addition of one or more other features, integers, steps, components or groups thereof. Similarly the words "upper", "lower", "right hand side", "left hand side" as used herein are for convenience of explanation and are not intended to limit the application of the device or technique of the present invention to any one specific configuration.

The invention claimed is:

1. An integrated mass spectrometer device formed from two multilayer wafers, each wafer having a first layer, second layer and having an insulating layer provided therebetween, the device having a plurality of electrode rods and a plurality of planar electrodes, the electrodes being formed in the first layer and electrode rods being provided in the second layer, the second layer being dimensioned to receive the electrode rods, the rods being retained in contact with the second layer by the provision of at least one silicon spring formed in the second layer.

2. The device as claimed in claim 1 wherein each of the multilayer wafers has three layers which are combined to form a five layer structure.

3. The device as claimed in claim 1 wherein the electrode rods are mountable in the second layers of each wafer.

4. The device as claimed in claim 1 wherein the electrode rods are located by etched features in the second layer of the wafer, the features being dimensioned so as to suitably receive a rod, and wherein the resilient members is formed by also etching the second layer.

5. The device as claimed in claim 1 wherein each of the first and second wafers are patterned with an outer pattern provided on the second layer, and an inner pattern provided on the first layer.

6. The device as claimed in claim 5 wherein the patterns provided on the first layer provides for ion source and ion collection components of the spectrometer.

7. The device as claimed in claim 4 wherein the insulting layer is provided in regions where the patterns overlap.

8. The device as claimed in claim 1 wherein the first and second wafers are bonded to form a monolithic block.

9. The device as claimed in claim 8 wherein the bonding of the first and second wafers is effected such that the electrode rods are located on an outer portion of the block and the electrodes in an inner portion of the block.

10. The device as claimed in claim 1 wherein the electrode rods form a mass filter component of the mass spectrometer.

11. The device as claimed in claim 10 including four cylindrical electrode rods, each rod having its diameter and centre-to-centre separation correctly chosen for quadrupole operation.

12. The device as claimed in claim 10 wherein the horizontal separation of the cylindrical electrodes within each wafer is defined by lithography and deep reactive ion etching.

13. The device as claimed 10 wherein the vertical separation of the cylindrical electrodes is defined by the combined thickness of the two bonded wafers.

14. The device as claimed in claim 1 wherein at least some of the plurality of electrodes are adapted to form ion entrance optics.

15. The device as claimed in claim 14 wherein the ion entrance optics are formed by an einzel lens.

16. The device as claimed in claim 14 further including a cold cathode field emission electron source provided in front of the ion entrance optics.

17. The device as claimed in claim 14 further including an electron source selected from one of:

a) a hot-cathode source, b) a DC discharge source, c) an AC discharge source, d) an electrospray source.

18. The device as claimed in claim 14 wherein a pair of RF electrodes are placed in front of the ion entrance optics in order to create a plasma.

19. The device as claimed in claim 14 wherein the ion entrance optics are formed from an etched fluid channel combined with a set of electrodes that together define an electrospray source.

20. The device as claimed in claim 1 wherein each of the wafers are bonded silicon on insulator wafers.

21. The device as claimed in claim 1 further including two or more distinct chambers, the provision of distinct chambers enabling the use of the device within a differentially pumped system.

22. The device as claimed in claim 1 further including an ion source provided in a mesh configuration.

23. The device as claimed in claim 1 wherein at least some of the plurality of electrodes are arranged in a mesh configuration.

24. The device as claimed in claim 1 wherein at least some of the plurality of electrodes are arranged in a rube arrangement.

25. The device as claimed in claim 24 wherein the tube arrangement provides a lens located at at least one of the entrance or exit to the electrode rods.

26. The device as claimed in claim 1 wherein at least some of the plurality of electrode rods are configured as ion reflectors.

27. The device as claimed in claim 26 wherein the ion reflectors are configured to provide a linear ion trap.

28. The device as claimed in claim 1 further including a filament element adapted to provide a source of electrons, the filament element being configured as one of the following types:

a) an externally provided filament, b) an integrally formed filament, or c) a removable filament.

29. A mass spectrometer system including a device as claimed in claim 1 in combination with an ion source and/or an ion detector, at least one of the ion source and/or ion detector being provided externally to the device.

30. A mass spectrometer array comprising a plurality of devices, each device being an integrated mass spectrometer device formed from two multilayer wafers, each wafer having a first layer, a second layer and having an insulating layer provided therebetween, the device having a plurality of electrode rods and a plurality of planar electrodes, the electrodes being formed in the first layer and electrode rods being provided in the second layer, the second layer being dimensioned to receive the electrode rods, the rods being retained in contact with the second layer by the provision of at least one silicon spring formed in the second layer.

31. A mass spectrometer system according to claim 30 comprising two or more devices, the two or more devices being provided in series so as to form a tandem mass spectrometer.

32. A mass spectrometer system as claimed in claim 31, wherein each of the devices forming the series of devices is a quadropole device and wherein a pair of RF electrodes are placed between the cascaded quadrupole devices in order to create a plasma.

33. A method of forming a mass spectrometer comprising the steps of:

a) providing a first and second wafer, each wafer having at least three layers, a first layer, a second layer and an insulating layer provided therebetween, b) on each wafer, etching an inner and outer pattern on the first and second layers respectively, the inner and outer patterns defining components for the spectrometer, the first layer of each wafer having at least one electrode formed thereon, the second layer of each wafer being dimensioned to receive at least one electrode rod, the second layer having at least one silicon spring formed therein the at least one silicon spring being adapted to retain a rod in contact with the second layer c) subsequently bonding the two patterned wafers together so as to form a multilayer stack d) inserting at least one electrode rod into the second layer of each wafer of the device.

34. A method as claimed in claim 33 wherein at least one of the distinct layers is provided by an etching step including at Least two masks.

35. A method as claimed in claim 33 wherein the step of providing the at least one electrode includes the provision of the at least one electrode in at least one of the following configurations:

a) a tube arrangement, b) a mesh arrangement, arid/or c) a diaphragm electrode arrangement.

36. A method as claimed in claim 35 wherein a mesh arrangement is provided so as to define at least a portion of a perimeter of a source cage into which electrons may be injected from an external filament.

37. A method as claimed in claim 35 wherein the diaphragm electrode arrangement is provided in the form of a three- electrode configuration, inner and outer electrodes of the three electrode configuration being configured to operate at the same potential.

* * * * *